US007097531B2

(12) United States Patent
Duchon et al.

(10) Patent No.: US 7,097,531 B2
(45) Date of Patent: Aug. 29, 2006

(54) SELF POWERED FIRE ALARM

(76) Inventors: Brent Duchon, 11352 Anegada St., Cypress, CA (US) 90630; Jeff Buss, 4307 Patrice Rd., Newport Beach, CA (US) 92663

( * ) Notice: Subject to any disclaimer, the term of this patent is extended or adjusted under 35 U.S.C. 154(b) by 239 days.

(21) Appl. No.: 10/849,667

(22) Filed: May 21, 2004

(65) Prior Publication Data

US 2005/0258970 A1 Nov. 24, 2005

(51) Int. Cl.
*G08B 17/02* (2006.01)

(52) U.S. Cl. ..... 446/106; 116/5; 116/158

(58) Field of Classification Search ..... 116/4, 116/5, 101, 106, 158; 242/395, 395.1, 400, 242/406, 912
See application file for complete search history.

(56) References Cited

U.S. PATENT DOCUMENTS

| | | | | | |
|---|---|---|---|---|---|
| 844,241 | A | * | 2/1907 | Bourne | 116/90 |
| 1,991,004 | A | * | 2/1935 | Munday et al. | 116/106 |
| 2,393,613 | A | * | 1/1946 | Combs | 242/395.1 |
| 2,408,043 | A | * | 9/1946 | Calabrese et al. | 242/395.1 |
| 2,609,786 | A | * | 9/1952 | Turner | 116/106 |
| 2,614,519 | A | * | 10/1952 | Paladino | 116/67 R |
| 2,938,493 | A | | 5/1960 | Pratt | |
| 2,999,477 | A | | 9/1961 | Pratt et al. | |
| 3,148,658 | A | * | 9/1964 | Kaplan | 116/106 |
| 3,529,567 | A | * | 9/1970 | Smiley et al. | 116/102 |
| 3,552,350 | A | | 1/1971 | Ranney et al. | |
| 3,570,446 | A | | 3/1971 | Buford | |
| 3,795,983 | A | | 3/1974 | Gallagher et al. | |
| 3,803,527 | A | | 4/1974 | Gallagher et al. | |
| 3,804,054 | A | * | 4/1974 | Gallagher | 116/106 |
| 4,503,800 | A | * | 3/1985 | Schliep | 116/221 |
| 4,979,693 | A | * | 12/1990 | Eberhardt et al. | 242/388 |

* cited by examiner

*Primary Examiner*—R. Alexander Smith
(74) *Attorney, Agent, or Firm*—Buhler & Associates; Kirk A. Buhler

(57) ABSTRACT

An improvement to a self powered fire alarm consisting of an improved housing sealing method that improves the reliability of the alarm by preventing insect infiltration. Additional improvements consist of an improved alarm activated notification, along with the incorporation of a wind down prevention detail and a retainer for the winding key. Each of these improvements provides additional benefit to the user.

14 Claims, 4 Drawing Sheets

SELF POWERED FIRE ALARM

FIELD OF THE INVENTION

The present invention relates to a self-powered fire alarm that is activated when the alarm is subjected to sufficient heat. More specifically the alarm is a wound spring driven mechanism where the mechanism is restrained from ringing the bell with a thermal fuse mechanism. When sufficient heat is applied to the thermal fuse, the fuse melts releasing a trigger and the alarm begins to ring. Improvements include an improved ringer sealing mechanism, an improved thermal fuse mechanism, a mechanical feature in the alarm housing that halts continued ringing of the alarm and a key holding mechanism.

BACKGROUND OF THE INVENTION

Many self-powered alarm mechanisms exist in homes, buildings, businesses, and are waiting to notify people when a fire has broken out. Most of these devices have been installed many years ago, and over time that may become none functional due to age, insects, dust or being painted by the owner.

One of the major problems that occur with self-powered alarms is that insects make homes in the alarm mechanism. U.S. Pat. Nos. 3,803,527, 3,570,446, 3,552,350 and 2,938,493 separate the mechanically wound mechanism from the ringer, but they all have the potential for insects to enter the area between the striker and the bell mechanism. U.S. Pat. No. 2,999,477 uses a pin welded onto the bell, but the area where the striker is located is subject to insects entering the striker area of the alarm.

The activation mechanism for the alarm can take a variety of similar configurations. In U.S. Pat. Nos. 3,803,527, 2,999,477 and 2,938,493 the activation mechanism is a metallic solder usually made from a eutectic alloy that melts at a specific temperature. When the solder melts, a cap held by the solder is released which in turn releases a keeper pin. The keeper pin restrains the drive mechanism, and when released, the alarm begins to ring. The cap in previous art is made of multiple pieces, which thermally insulate the cap and deflect airflow slowing the temperature reaction. The prior art of the fuse also allows painting over spray to cover the warning portion of the fuse and complicates the manufacturing of the fuse.

Once the alarm has been activated, the alarm will continue to ring until the energy stored in the alarm spring has been exhausted. What is needed is a mechanism that can stop the ringing of the alarm after it has begun and before all of the energy stored in the spring has been exhausted.

Often self-powered alarms need to be inspected to determine if the alarm spring is completely wound. This can be accomplished by inserting a key into the alarm and rotating the key to determine if the spring is fully wound. When this operation needs to be performed, the person performing the inspection must locate a key. None of the prior art provides an obvious key storage location on the alarm so that the inspection can be performed without the inspector providing a special winding key.

While these devices provide a self-powered alarm, they do not completely address potential contamination from insects, allow the fuse to react to temperature changes as quickly as possible, ability to directly halt the alarm spring rotation and provide an obvious location within the housing to store a winding key.

SUMMARY OF THE INVENTION

It is an object of the present invention to provide a self powered fire alarm that provides superior protection from insect infiltration. In addition, the invention will provide a superior temperature response. A further improvement will include an alarm control detail that is capable of halting continued alarm sounding before all the energy in the alarm spring has been exhausted. A still further improvement is that the alarm includes a mechanism that can store the alarm-winding key for future use. The invention is intended to provide these features and improvements. A brief summary of the benefits from these improvements and features are expanded upon herein.

The need to eliminate or reduce the potential of insects entering the ringing, striking and drive mechanism is important. Insects can live within or pack the inside of the bell housing with debris that can significantly change the tone and volume of the ring. Insects such as hornets pack the inside of the alarm with dirt and mud that may totally prevent the alarm from operating. The benefit of keeping insects out of the alarm can be the difference between saving lives by warning people that a fire is in progress, and people not reacting to life threatening situations.

A simplified and superior fuse assembly design will allow the cap to separate from the fuse assembly sooner and start the bell ringing sooner. It will also prevent painting over spray from covering the warning message under the cap. The design is of a one piece cap will increase the heat transfer to the solder and simplify the manufacturing of the fuse assembly.

The need to halt an alarm from ringing is desirable when the alarm is in the process of being installed or tested, and will otherwise continue to ring until all the energy in the spring has been exhausted. The alarm sound is loud, and if the alarm is being tested, once the mechanism is found to be in good operation, the need for the alarm to wind completely down may not be necessary. The integration of a mechanism that allows the user to halt the alarm sounding when the alarm is under test is an additional benefit.

Storage of the winding key with the unit provides additional convenience to the user. Most alarms require a specific tool or key to wind an alarm. When the tool is not available, the job will take longer to perform because often the original tool supplied with the unit has been stored in a location that is not easy to locate or the key is lost. The lost key potentially results in an alarm that is not wound and will not warn of a fire. If the user can simply remove the tool from the product, perform the required operation and return the key to its original location, a tremendous advantage to the user in both time and effort, while potentially increasing their safety, can be achieved.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
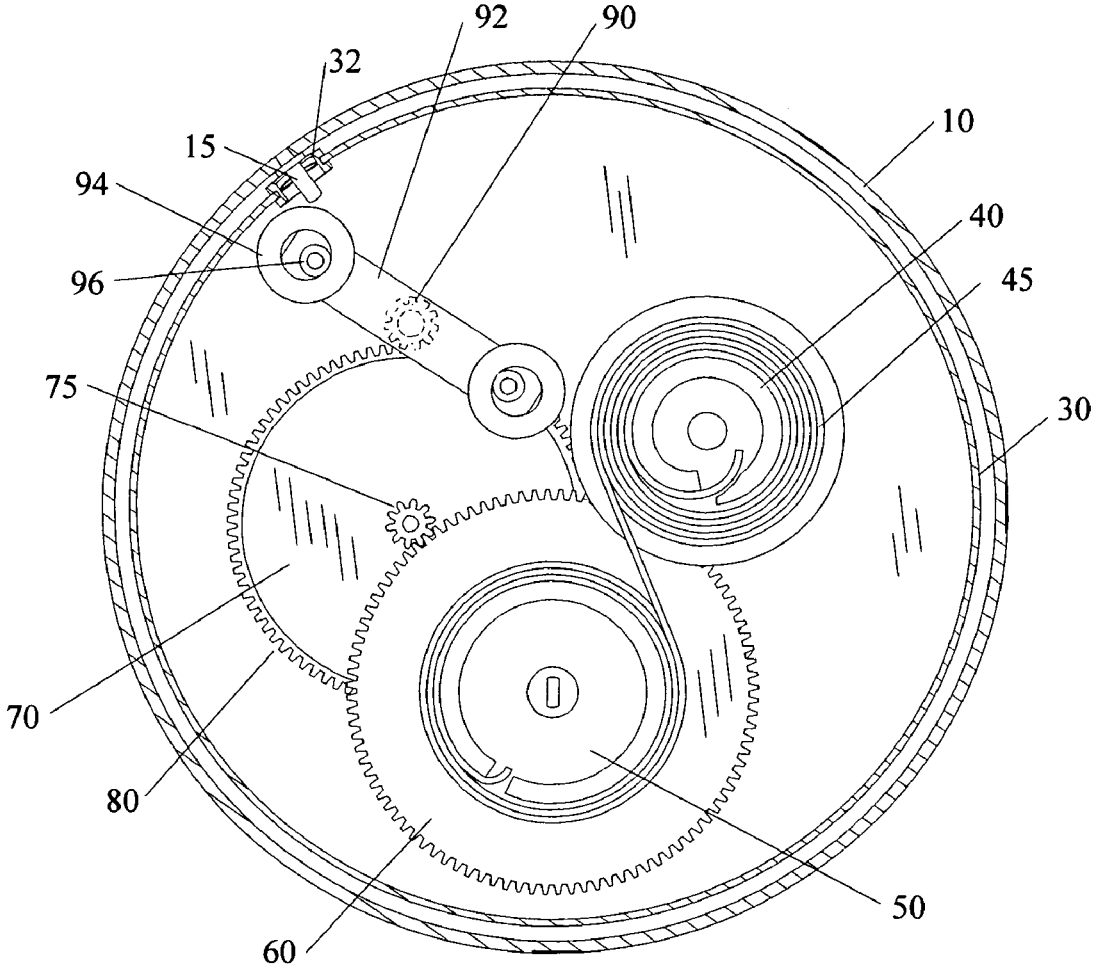
FIG. 1 is a cross sectional top view of alarm mechanism invention.

Referring first to FIG. 1, that shows a cross sectional top view of the invention. Item 10 is the outer bell for the alarm. In the preferred embodiment, the bell is made from a metallic material that has high resonant value. The bell is made from an aluminum alloy metal, but the material could be made from a variety of other materials that are capable of sounding or ringing when they are struck. The outer surface of the bell is coated to protect the surface from corrosion. The bell can be painted, plated, powder coated or has other surface treatment that reduces corrosion without causing a significant reduction of the resonant property of the bell. Item 30, is the enclosed inside frame that houses the mechanism. The enclosed inside frame can be mounted to a wall or ceiling with a bracket that is attached to the wall or ceiling and the alarm can then be mounted to the bracket. The bell 10 has a bell stud 15 that is mechanically attached to the bell. The bell stud extends from the bell through the frame, such that a portion of the bell stud is exposed within the sealed frame. Where the bell stud enters the frame, a seal 32 may be integrated into the frame to further improve the sealing of the mechanism.

The mechanism consists of a wound spring 45. In the preferred embodiment, the wound spring is a constant force spring, but the spring may be a coiled clock spring, extension or compression spring. The purpose of the spring is to provide a source for energy that does not degrade over time. A constant force spring is preferred because the force exerted by the spring is essentially the same as the spring begins to unwind until the unwinding of the spring ends. As the spring unwinds, the spring transfers from the primary spool 40 to the secondary spool 50. As the spring unwinds onto the secondary spool, the secondary spool turns the gear 60. Gear 60 then turns gear 75 that is attached to a speed increasing gear 70. The speed increasing gear 70 has gear teeth 80 engaged with gear 90 attached to the bell ringer assembly 92. In the preferred embodiment, two speed-changing gears are used to increase the speed of the spring unwinding, but the ringer assembly 92 could be attached directly to spools 40, 50 or 70. More than two speed-changing gears may also be used.

The bell ringer assembly consists of a two-ended member 92. At the ends of the member are hammer rings 94 which are held in loose connection to the two-ended member by retaining pins 96. The hammer rings are restrained such that they can move on the two-ended member and contact the bell stud 15 that is attached to the bell as the hammer rings are spun on the two-ended member. As the two-ended member turns, centrifugal force pushes the hammer rings towards the outside of the two-ended member. When the hammer rings make contact with the bell stud, the hammer ring striking the stud moves inward, and allows the two-ended member to spin past the bell stud. The two-ended member with hammer rings is shown as a preferred embodiment, but other methods of striking the bell stud are possible such as rotating hammers that are connected to pivot pins.

Figure 2:
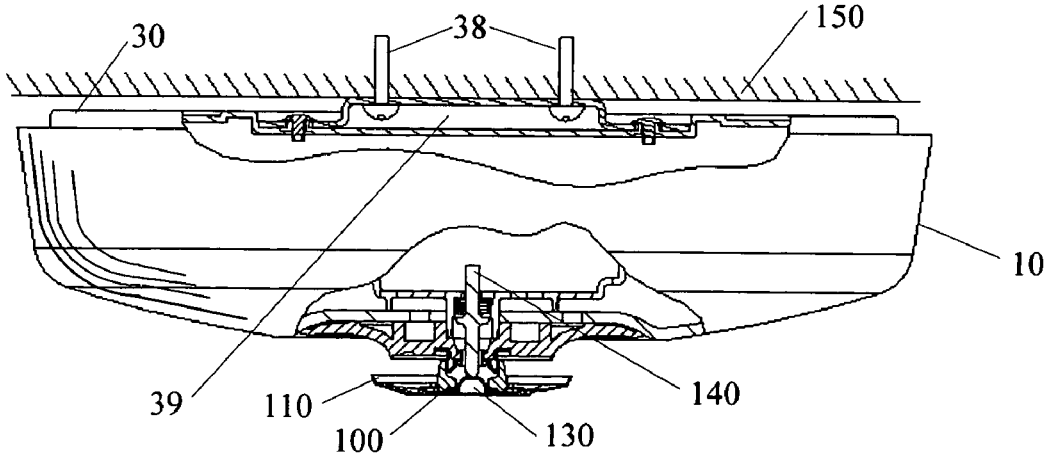
FIG. 2 is side sectioned view of the fuse and bracket mechanism invention.
Figure 3:
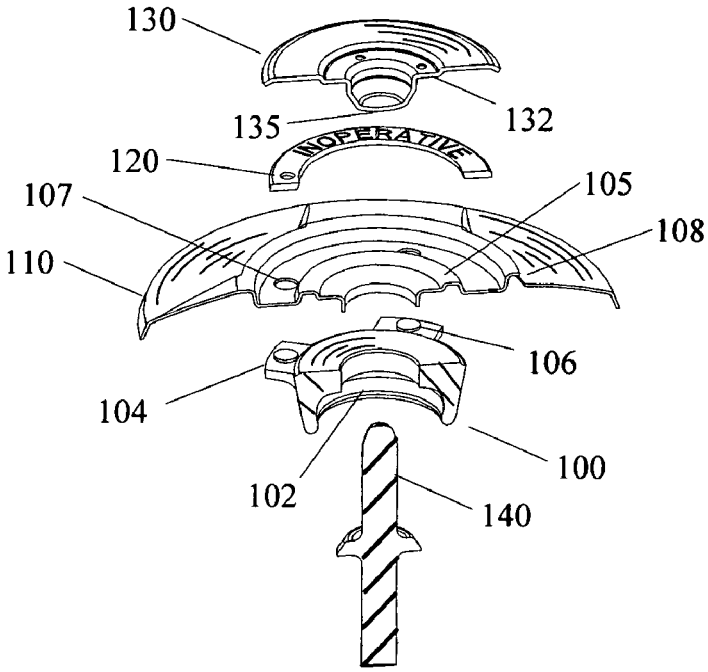
FIG. 3 is a sectioned isometric exploded view of the fuse assembly invention.

Refer now to FIG. 2 that shows a cut away cross sectional view of the fuse activation assembly location on the alarm. From this figure, the frame 30 is shown attached to a ceiling 150 with screw(s) 38 that go through the mounting bracket 39. The bell is 10 shown in this figure. Fuse assembly components 100, 110, 130, and 140 are shown, as they exist in the alarm. These components are better identified in FIG. 3 that shows a detailed exploded view of the components in the fuse activation assembly. In FIG. 3, the base 100 of the fuse assembly is made from a molded plastic material in the preferred embodiment, but could be made from a metallic material. The base consists of a circular part with a hole in the center 102, and at least two ears 104. The keeper pin 140 is located within the center hole 102. The center hole provides a passage for the keeper pin within the fuse assembly. On the top of the ears 104, a pin 106 extends from at least two of the ears. These pins extend through a metallic outer fuse member 110, through holes 107, and connect to the "INOPERATIVE" information ring 120. The metallic outer fuse member is formed from a flat piece of metal, and is essentially a dome shaped disk with vents formed in the disk to allow for air circulation. The metallic outer fuse member is made from copper or a copper based alloy. The outer fuse member has at least one vent hole 108 to allow air to pass though the fuse assembly. The ventilation hole allows air movement through the fuse assembly to improve the heat transfer and prevent cold air from being trapped within the fuse assembly. The information ring 120 has printing to indicate if the bell has operated and needs to be reset. In the preferred embodiment, the information ring is molded and imprinted with lettering to indicate that the alarm is inoperative. The information ring is covered with a metallic fuse cap 130. The metallic fuse cap is formed from a flat piece of metal, and is essentially a dome shaped disk shaped as shown in FIG. 3. The metallic fuse cap 130 is held in position on the outer fuse member 110 with a thermal bonding agent connecting the two parts together at locations 132 and 105. The thermal bonding agent holds the two parts together under normal temperature. The bond holds the metallic fuse cap 130 onto the outer fuse member 110 constraining trigger pin 140 movement at location 135. When sufficient heat is applied to the fuse assembly, the bond between 110 and 130 is weakened, and the trigger pin 140 pushes the metallic fuse cap 130 off the fuse assembly. When the trigger pin 140 is in the activation position, the alarm will begin to sound. When the metallic fuse cap is pushed off, the information ring 120 is exposed notifying an inspector that the alarm is inoperative. The bond is designed to release at a predetermined temperature. The manufacturing method of joining these two parts consists of placing a bonding agent of essentially solder with a particular melting point between 132 and 105, and subjecting the assembly to a temperature sufficient to melt the solder and bond the two parts. Alternate methods of manufacturing consist of placing plastic, chemical bonding agents with specific bonding breakdown temperatures between parts 110 and 130. While the preferred embodiment uses melting points of 117°, 136° and 175° F., higher and lower melting points can be used as an effective alarm temperature.

Figure 4:
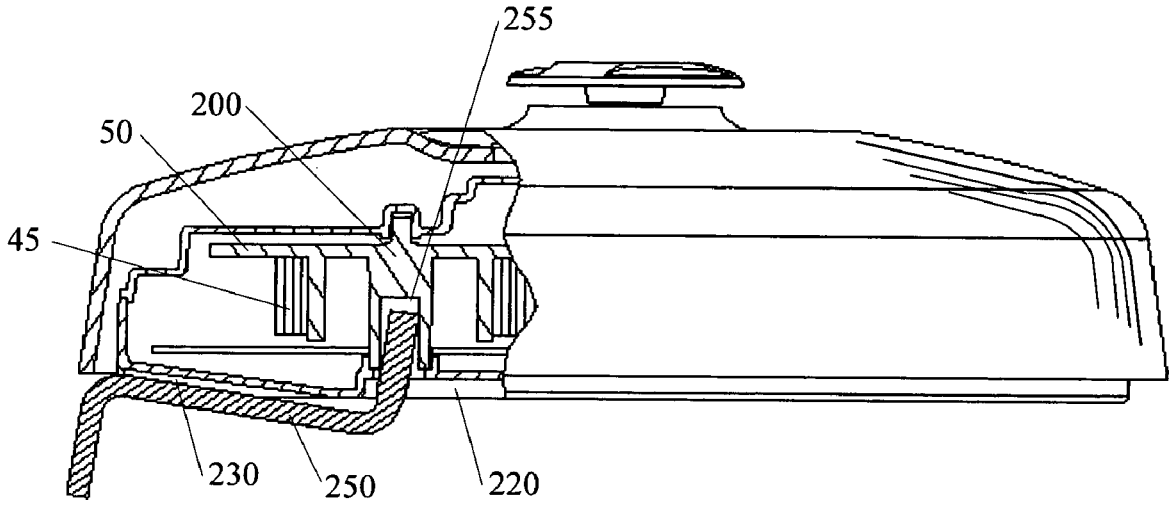
FIG. 4 is a sectioned side view of the bottom of the winding key invention.
Figure 5:
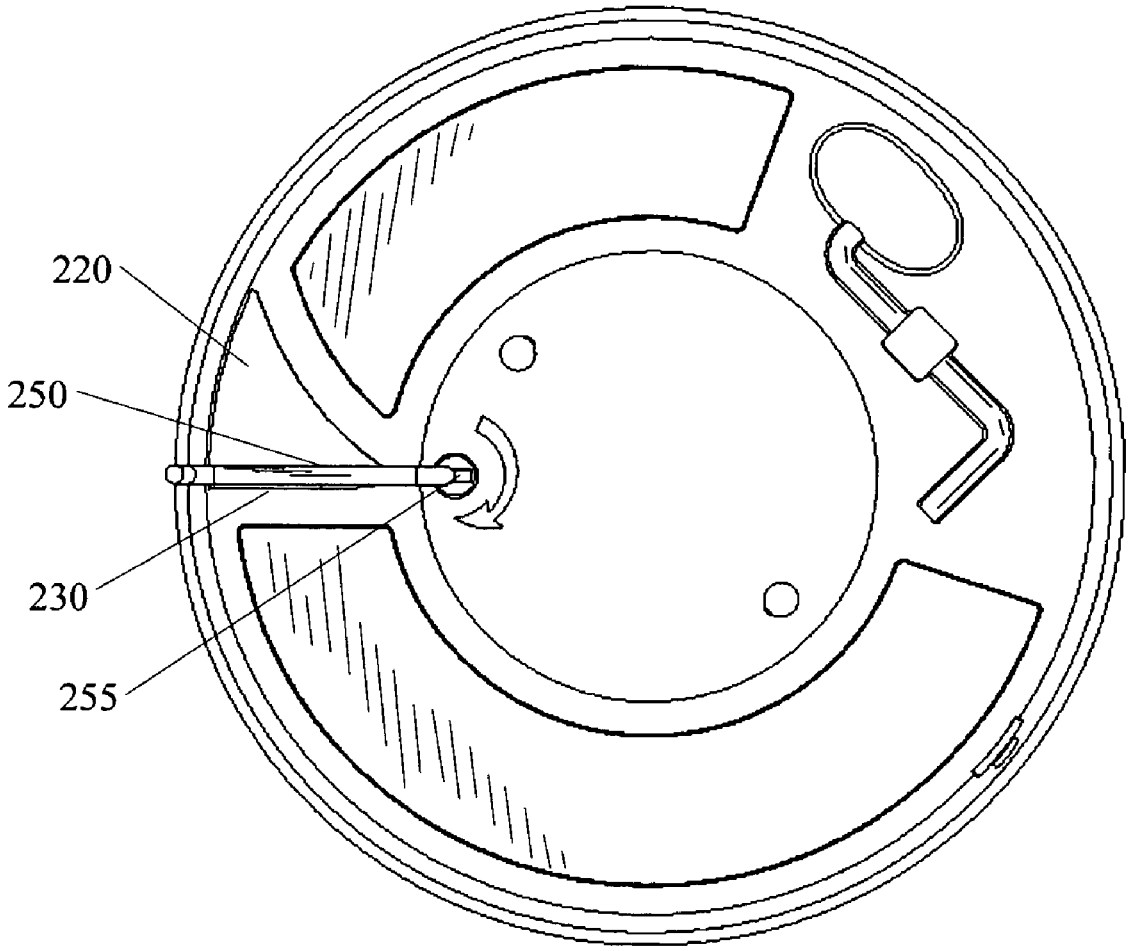
FIG. 5 is a bottom view of the winding key unwinding prevention invention.

Refer now to FIG. 4 that shows the sectioned side view and FIG. 5 that shows a back view of the winding key 250 in the alarm unwinding halted position. The hub 200 of the secondary spool 50 contains a rectangular hole 255 that a winding key 250 can be placed into to wind the alarm spring 45. The winding key 250 is an "S" shaped piece of round material that has a flat pressed or machined into one end. The flat portion of the key can be placed into the rectangular winding hole 255 to wind or halt the alarm. In FIG. 5, the notched area 220 represents a recessed area on the frame assembly forming a wall 230 for the key to stop the key from rotating. The function of this recessed area is to halt the ringing of the alarm once the alarm begins to ring by restraining the rotation of the winding key 250. Once the alarm begins to ring, the key can be placed into the rectangular hole in the hub 200, and as the hub turns the key, the side of the winding key will come in contact with the recessed area wall 230, and the ringing will halt because the key will prevent further rotation of the hub. Similarly, a raised portion of the frame can be used to prevent rotation of the winding key. This recessed or raised area can be molded into the housing, or can be formed into the housing from a bending operation, or can be an additional component bonded, screwed or attached to the housing with some manufacturing process.

Figure 6:
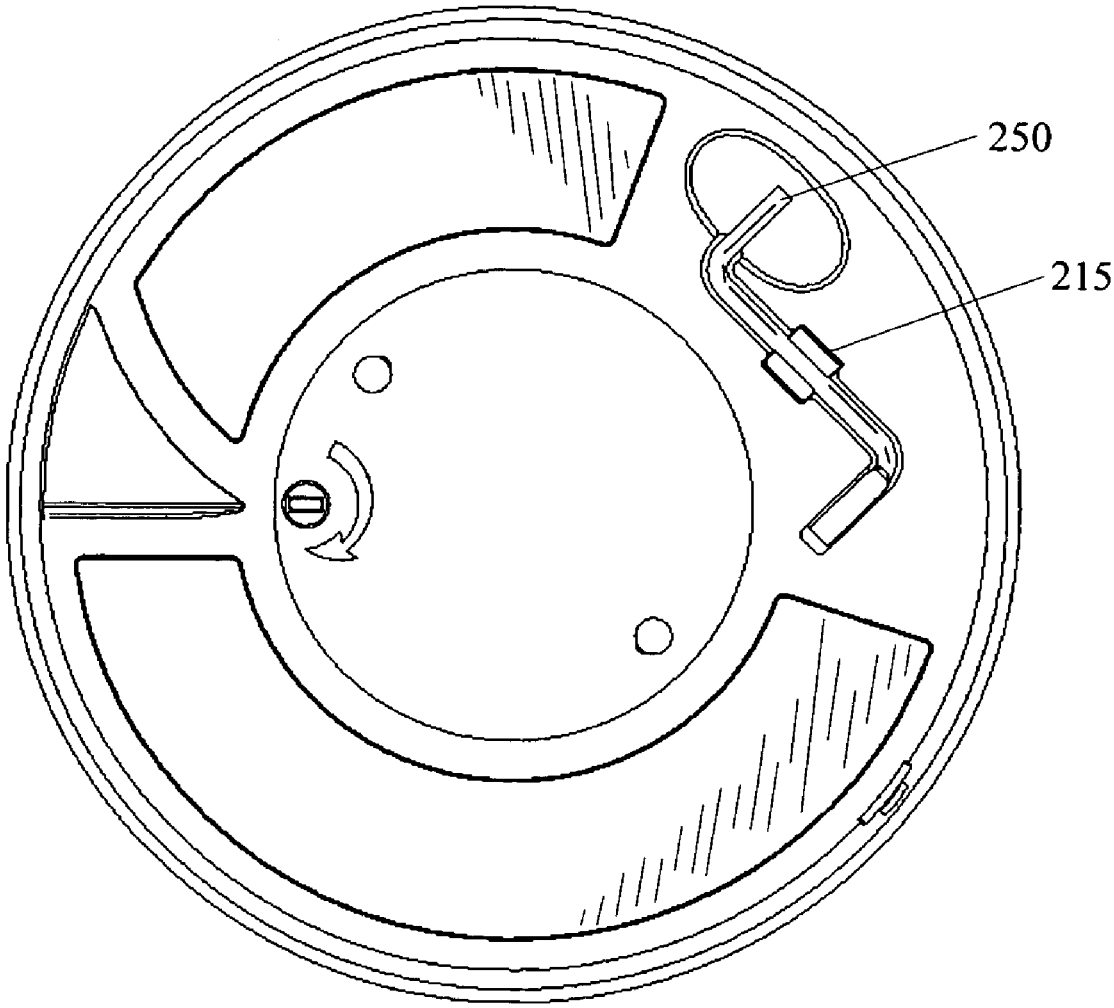
FIG. 6 is a bottom view of the winding key retention invention.

FIG. 6 shows a retaining feature that holds the winding key 250, onto the back of the alarm housing. The key can be used to wind the alarm or to ensure that the alarm is completely wound. The winding key retention detail 215 is essentially a "U"-shaped channel that holds the key in position when the key is not in use. The key retaining detail is shown as a "U"-shaped detail, but the detail can be any shape that retains the key for future use. The retention of the key is useful since it may be many years between when the alarm is installed and the winding of the alarm is checked increasing the risk of losing the winding key and not having a fire alarm that is activated.

Thus, specific embodiments and component arrangements for a self-powered alarm have been disclosed. It should be apparent, however, to those skilled in the art that many more modifications besides those described are possible without departing from the inventive concepts herein. For example, the storage energy for the alarm may be a pneumatic cylinder instead of a spring. The alarm bell could be made from glass, or be tubular in shape instead of dome shaped. The inventive subject matter, therefore, is not to be restricted except in the spirit of the appended claims.

What is claimed is:

1. A heat activated fire alarm comprising;

an outer bell with a striking pin attached to die bell where the striker pin extends into an enclosed inside frame through a sealing gasket.

2. The heat activated fire alarm from claim 1 where the enclosed inside frame contains a spring wound drive mechanism that strikes the striking pin with hammer rings that do not operate outside the enclosed inside frame.

3. The heat activated fire alarm from claim 1 where the striker pin is struck with a two ended hammer member.

4. The heat activated fire alarm from claim 1 where the fire alarm is activated when heat is applied to the outer surface of the fire alarm.

5. The heat activated fire alarm from claim 1 wherein upon activation of the fire alarm a status indicator is exposed.

6. The heat activated fire alarm from claim 1 wherein a fuse cap retains a spring loaded trigger pin for activating the fire alarm.

7. A tire alarm wind down prevention mechanism comprising;

a wound fire alarm with a ring stop detail in the fire alarm housing such that when the alarm is ringing, a key can be inserted into the wound fire alarm and the key can make contact with the ring stop detail in the fire alarm housing to halt continued ringing of the wound tire alarm.

8. The alarm wind down prevention mechanism in claim 7 where the detail consists of a recessed notch that the key contacts halting the alarm mechanism rotation.

9. The alarm wind down prevention mechanism in claim 7 where the detail consists of a raised post that the key contacts halting the alarm mechanism rotation.

10. The alarm wind down prevention mechanism from claim 9 where the raised post consists of a part attached to the fire alarm housing.

11. The fire alarm wind down prevention mechanism alarm from claim 7 where the fire alarm includes a spring wound sounding mechanism.

12. The fire alarm wind down prevention mechanism alarm from claim 7 where the fire alarm is activated when heat is applied to the outer surface of the fire alarm.

13. The fire alarm wind down prevention mechanism alarm from claim 7 where the fire alarm upon activation exposes a status indicator.

14. The fire alarm wind down prevention mechanism alarm from claim 7 where a fuse cap retains a spring loaded trigger pin for activating the fire alarm.

* * * * *